US005879152A

United States Patent [19]

Griffel

[11] Patent Number: 5,879,152

[45] Date of Patent: Mar. 9, 1999

[54] SOCKETLESS DRIP PREVENTING CANDLE HOLDER

[76] Inventor: Giora Griffel, 196-J Howard Dr., Bergenfield, N.J. 07621

[21] Appl. No.: 95,997

[22] Filed: Jun. 11, 1998

[51] Int. Cl.[6] ..... F23D 3/16; F23D 3/18

[52] U.S. Cl. ..... 431/293; 362/161; 362/447

[58] Field of Search ..... 431/293, 292, 431/289; 362/161, 162, 163, 447

[56] References Cited

U.S. PATENT DOCUMENTS

| | | | |
|---|---|---|---|
| 84,103 | 11/1868 | Faote . | |
| D. 288,722 | 3/1987 | Uarada | D26/11 |
| 945,963 | 1/1910 | Lang | 362/447 |
| 964,841 | 7/1910 | Berau | 431/293 |
| 1,175,057 | 3/1916 | Goeddertz . | |
| 1,200,121 | 10/1916 | Knapp . | |
| 1,255,614 | 2/1918 | Knapp . | |
| 1,365,485 | 1/1921 | Guest . | |
| 2,503,236 | 4/1950 | Churchill | 431/293 |
| 3,071,952 | 1/1963 | Churchill . | |
| 3,767,910 | 10/1973 | Stratton | 240/10 B |
| 4,544,351 | 10/1985 | Marsicano | 431/288 |
| 4,566,055 | 1/1986 | Klees | 362/162 |
| 4,755,135 | 7/1988 | Kwok | 431/291 |
| 5,057,005 | 10/1991 | Kwok | 431/253 |

FOREIGN PATENT DOCUMENTS

| | | | |
|---|---|---|---|
| 3001359 | 7/1981 | Germany . | |
| 9-16517 | 6/1997 | Japan . | |
| 230229 | 3/1925 | United Kingdom | 431/293 |
| 2067739 | 7/1981 | United Kingdom . | |

*Primary Examiner*—Carl D. Price
*Attorney, Agent, or Firm*—Robert W. J. Usher

[57] ABSTRACT

A candle holder includes a drip preventing and stabilizing cap member of transparent glass descending on the candle throughout consumption with an annular shoulder portion, a central, wick receiving aperture with a lip for melted wax and a depending skirt; a stand with a socket-less candlestick having a shallow, concave candle supporting surface receiving melted wax and receivable in the skirt to provide a wax seal; and vertical metal guide rods. In one example, the guide rods depend from a metal annulus sitting on a outwardly flared lower portion of the skirt and slide in sockets on the stand ensuring vertical descent of the cap. Alternatively, the guide rods are anchored in the foot of the stand and the sockets are in the metal annulus. In a different version, pairs of metal guide rods are anchored in opposite sides of the foot of the stand defining vertical sockets slidingly receiving rods which extend outwardly from the annulus and carry weighty knobs at free ends. Alternatively, a cap guiding ring is mounted, flag fashion, on the top of a rod upstanding from the base, in coaxial relation above the candle supporting surface, trapping the cylindrical skirt between the candle supporting surface and the guide ring, throughout burning.

10 Claims, 6 Drawing Sheets

SOCKETLESS DRIP PREVENTING CANDLE HOLDER

FIELD OF THE INVENTION

The invention relates to a socketless, drip preventing candle holder.

BACKGROUND OF THE INVENTION

The problems associated with dripping candles, complete burning and effective candle mounting are well recognized and there have been numerous attempts to provide solutions for more than one hundred years.

For example, U.S. Pat. No. 1,200,121 issued in 1916 to Knapp teaches a sanctuary lamp which includes a socketless drip preventing candle holder of the type comprising: a drip preventing and a candle stabilizing cap member having an annular shoulder portion for sitting on a shoulder of the candle to descend under gravity during consumption thereof and a central, wick receiving aperture with a lip to contain melted wax and a skirt depending from the annular portion, spaced from the candle body; a stand having a base and an upstanding socket-less candlestick with a shallow, concave candle supporting surface at least as wide as the candle for containing melted wax and receivable in sealing engagement within the cap during the last stages of consumption of the candle to prevent leakage of melted wax; complementary cap guiding means on the cap means and stand including metal guide rods extending vertically between the cap means and the stand on opposite sides of the candle and socket means slidingly receiving the guide rods; whereby the complementary guide means maintains the drip preventing cap member on a fixed vertical axis prior to and throughout descent under gravity down the candle body during consumption thereof with the cap member retaining the candle upright on the candle supporting surface.

In the construction disclosed in the above-mentioned patent, the cap means comprises a massive metal member from which the skirt depends vertically, lower ends of the guide rods are anchored in the stand and upper ends are slidingly received in sockets extending vertically, completely through the skirt and the massive annular portion of the cap.

However, as pointed out in Knapp's subsequent U.S. Pat. No. 1,225,614, issued in 1918, the prior construction was not satisfactory, as the heavy metal cap member frequently tended to cant on the rods and the rods became coated with wax, preventing true and free descent of the cap so that the cap did not tightly seal the candle support and wax leaked throughout burning.

In an attempt to overcome these disadvantages, Knapp's later patent directs a different approach, substituting a cap of transparent vitreous material for the massive metal cap and eliminating the guide rods, instead relying on complex profiling of the cap interior to facilitate centering on the candle during descent and providing a candle supporting surface restructured with a socket forming profile of greater depth with a peripheral rubber seal.

However, the requirements for a rubber seal and complex restructuring increase the manufacturing expense of the candle holder while the profiled socket requires a matching profile on the bottom of the candle which obviates use of a simple and inexpensive generic candle, decreasing versatility and further increasing both manufacturing and operating costs.

Even so, as a result of the increased depth of the wax receiving socket, apparently, the candle will not be completely consumed as the resulting enclosure formed at the final stage of candle burning appears so deep as to cause the flame to be extinguished through lack of oxygen.

A second type of a drip preventing candle holder is taught by U.S. Pat. No. 1,365,485 issued in 1921 to Guest also comprises a drip preventing and candle stabilizing cap member having an annular shoulder portion for sitting on a shoulder of the candle to descend under gravity during consumption thereof and a central, wick receiving aperture with a lip to contain melted wax and a cylindrical skirt depending from the annular portion; a stand having a base and an upstanding, socket-less candlestick with a candle supporting surface and receivable in sealing engagement within the cap during the last stages of consumption of the candle to reduce or prevent leakage of melted wax; and complementary cap guiding means on the cap member and base. However, the guiding means includes the skirt which is longer than the candle so as to slidingly receive the candlestick to guide the descent of the cap member to maintain the candle upright on the candle supporting surface throughout burning.

In the Guest patent, the candlestick is of constant width, substantially equal to the width of the candle and supporting surface and, preferably, the guiding means includes a cylindrical sleeve member upstanding from the base of the stand surrounding the candlestick in coaxial relation to provide therebetween a skirt receiving socket. As the skirt is of greater axial length than the candle it is guided by sliding receipt in the socket during burning ensuring even vertical descent of the cap member. Furthermore, the lip is extended to provide a large bowl as necessary to contain the increased amount of wax melted as a result of the high thermal conductivity of the cap which is apparently metal.

However, that construction is relatively bulky and heavy, also requiring vent holes at an upper end for cooling the candle body and to drain back reliquified wax from the bowl at the final stage of burning adding to complexity and manufacturing cost. Removal of any wax leaking into the socket can be relatively time consuming and difficult. In addition, the candle body is concealed from view substantially completely throughout burning by the metal cap member.

Other prior cap members and candle holders are taught by U.S. utility Pat. Nos. 84,103; 3,071,952; 3,767910; 4,544,357; 4,566,055; 4,755,135; 5,057,005; U.S. design Pat. No. 288,722; U.K. patent application publication 2,067,739 and Japanese patent application publication 9161517.

SUMMARY OF THE INVENTION

It is an object of the invention to provide a socketless, drip preventing candle holder which operates effectively to ensure total, leak free consumption while permitting use of a generic candle.

Another object of the invention is to provide a candle holder which permits the candle body and flame to be seen throughout burning.

A further object of the invention is to provide a candle holder that can be easily cleaned.

An additional object of the invention is to provide a candle holder which is of relatively simple construction suitable for economic production by conventional mass production techniques.

According to the invention, in a socketless, drip preventing candle holder of the first type referred to above, the improvement resides in that the cap member is made of transparent glass and a lower edge portion of the skirt flares radially outwardly, the metal guide rods are carried in depending relation by a metal annulus which sits on the outwardly flared portion of the cap and extend around the candle, and the stand has a lateral bearing member formed with guide rode receiving sockets at a height above the foot or base to permit full descent of the cap and, in that the candle supporting surface engages the cap adjacent the aperture to permit total consumption of the candle.

This construction will eliminate risk of contamination of the guide rods with wax and provide sufficient lateral support and guidance for the cap throughout descent to enable both the essentially socketless structure to be maintained with total, drip-free consumption of a universally available, generic candle type with some thickness variation accommodated.

As the metal annulus, not the cap, carries the metal rods, the cap can be made of glass with less risk of breakage.

As the mass of the annulus and guide rods are spaced radially apart from the central axis, the cap stability is improved, reducing risk of canting, while the provision of the annulus as a separate member located above the skirt also avoids risk of wax contamination with the separability facilitating ready disassembly for cleaning.

Substantially the entire candle is exposed to view throughout burning maintaining the desired natural and symbolic quality of the living flame which is the primary reason for candle use in homes and restaurants.

In an alternative embodiment, the guide rods are anchored in the foot of the stand and the rod receiving sockets are formed in the metal annulus. This reduces the height and enables the stand to be stand-alone or supported in elevated position by attachment to the top of a conventional candle holder.

In another alternative embodiment, pairs of metal guide rods are anchored in opposite sides of the foot of the stand with the rods of each pair being closely spaced apart so as to define between them vertical socket forming slots, and mounting rods extend radially outwardly from opposite sides of the annulus and carry weighty knobs at free ends whereby the rods will remain captive in respective slots with the cap seated on the candle prior to and throughout consumption of the candle, guiding the cap member throughout descent.

According to another aspect of the invention, in a candle holder of the second type, the cap member is made of transparent glass with the skirt spaced form the candle body and the candlestick can comprises a stem of any profile equal or less in transverse width than the candle supporting surface and, the guide means includes a guide ring mounted, flag fashion, by a rod upstanding from the base to extend in coaxial relation with the candle supporting surface and stem so as to trap the skirt between the candle supporting surface and the guide ring thereby guiding the cap member throughout descent.

The provision of the guide ring enables the stem to be thin while providing adequate guidance for the cap member, obviating need for the sleeve of the Guest patent, reducing weight complexity and cost and maintenance while the transparency of the cap member enables the candle to be viewed substantially completely throughout burning maintaining the desired atmospheric effect. The spacing apart of the skirt from the candle boy avoids any frictional resistance to descent of the cap member.

Preferably, the guide ring is positioned above the candle supporting surface enabling the length of the skirt to be maintained at a minimum in relation to the height of the candle while providing accurate support at the commencement of burning, further reducing weight. Alternatively, the height of the candle can be maximized.

BRIEF DESCRIPTION OF THE DRAWINGS

Specific embodiments of the invention will now be described by way of example only with reference to the accompanying drawings in which.

DESCRIPTION OF PARTICULAR EMBODIMENTS

Figure 1:
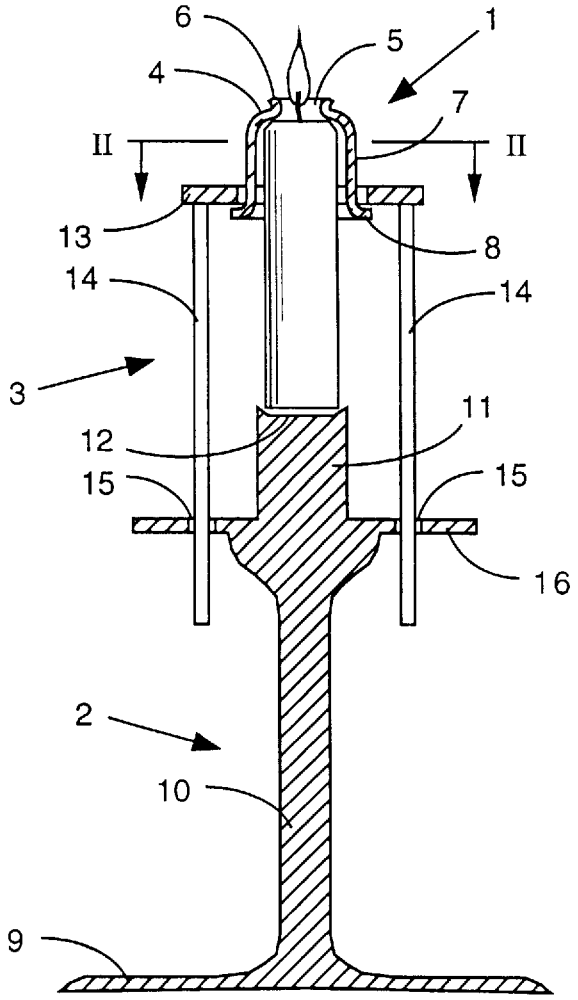
FIG. 1 is an elevational view, partly in cross-section of a first embodiment of socketless drip preventing candle holder with the candle partly consumed.
Figure 2:
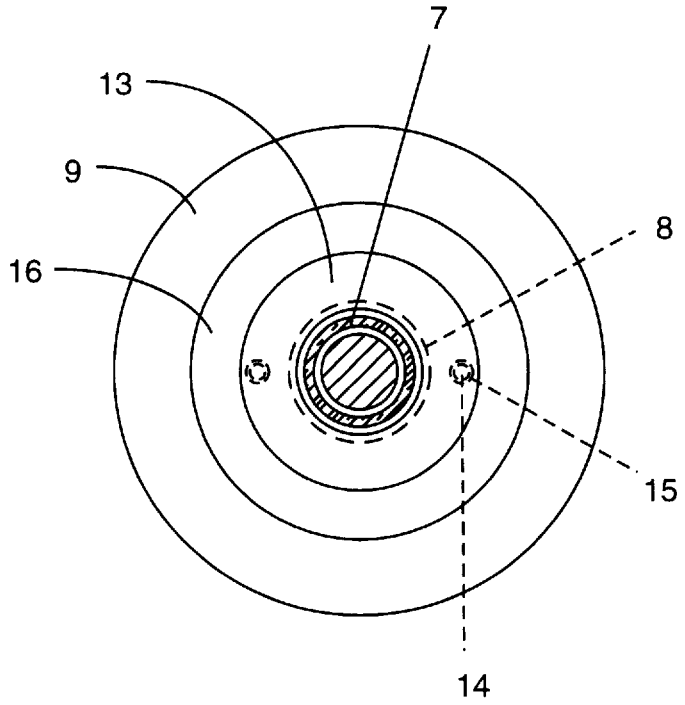
FIG. 2 is a cross-sectional view taken along line II—II of FIG. 1.
Figure 3:
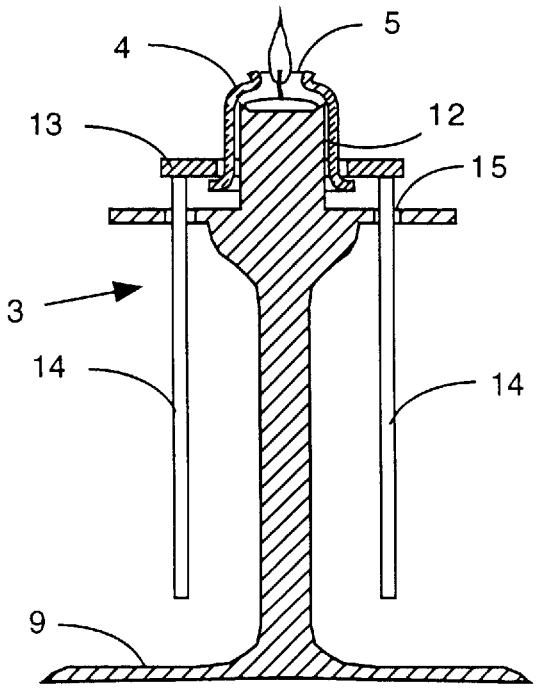
FIG. 3 is view similar view to FIG. 1 but at the final stage of consumption of the candle.

The first embodiment of the invention, shown in FIG. 1–3, comprises a drip preventing and candle stabilizing cap member 1, a stand 2 and a cap guiding assembly 3.

The cap member 1 is made of heat resistant, transparent glass and has an annular shoulder or constriction 4 for sitting on an upper shoulder of the candle formed with a central, wick receiving aperture 5 with a lip 6 to contain melted wax and, a skirt 7 depending from the annular shoulder 4, spaced from the candle body, a lower portion of the skirt extending outwardly forming a radially outwardly flared edge portion 8.

The stand 2 has a base 9 and an upstanding socket-less candlestick 10 with a shallow concave candle supporting surface 12 at least as wide as the candle.

The cap guiding assembly 3 comprises a metal annulus 13 which sits on the portion 8 of the skirt 7 so as to extend around the candle, spaced radially outwardly therefrom and carries metal guide rods 14 in depending relation which are slidingly received in respective guide rod receiving sockets 15 located in a circular bearing member 16 provided on the stand at a sufficient height above the base 9 to permit full descent of the cap member. A portion 11 of the candlestick upstands above the bearing member 16 a distance at least equal to the height of the skirt 7 enabling the cap to descend sufficiently to bring the shoulder 4 into sealing engagement with the periphery of the candle supporting surface 12.

In operation, sliding receipt the guide rods in the sockets maintains the entire cap member on a fixed vertical axis throughout gravitation down the candle body throughout total consumption thereof so that the cap member retains the candle in a vertical position on the candle supporting surface while any risk of the cap member tilting is further reduced by the perimeter weighting arising from the metal annulus and guide rods. As indicated in FIG. 3, at the end of the descent, the cap member comes to rest with the candle supporting surface 12 in sealing engagement with the annular shoulder 4 adjacent the aperture so that the resulting enclosure is sufficiently shallow to permit total consumption of the candle while preventing leakage of melted wax pooling in the concavity.

Additional, cooperative guide rods and sockets may be provided, normally located at equally spaced apart intervals around the periphery.

Figure 4:
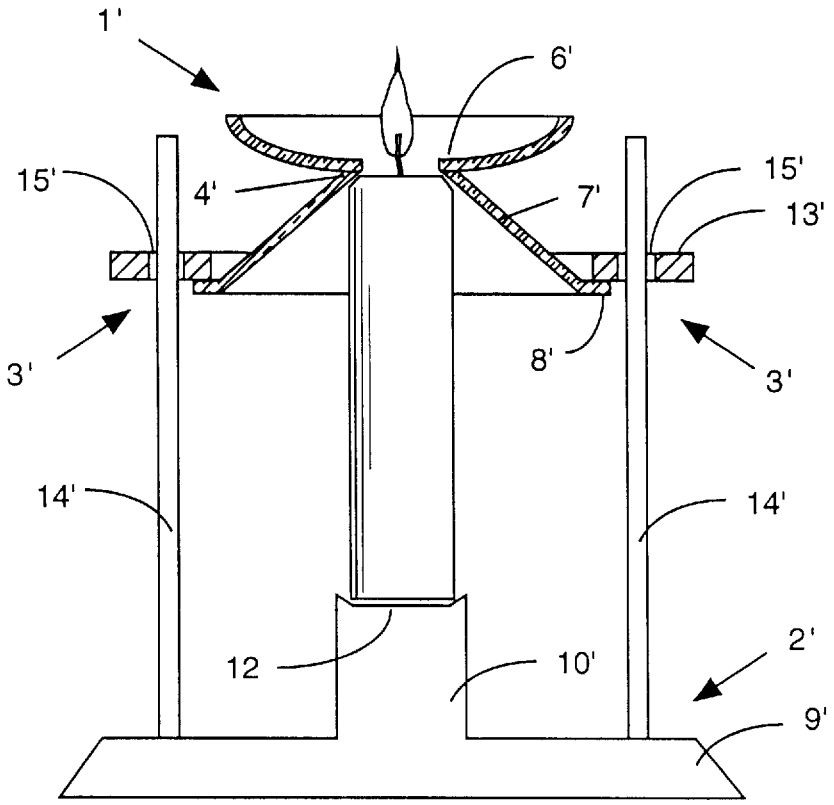
FIG. 4 is an elevational view, partly in cross-section of a second embodiment of socketless drip preventing candle holder with the candle partly consumed.

In the second embodiment, shown schematically in FIG. 4, the guide rods 14' of the guide means 3' are anchored in the base or foot 9' of the stand 2' and the rod receiving sockets 15' are provided in the metal annulus 13' at opposite diametrical locations. The cap 1' is modified in having an extended lip 6', flaring outward and upward to form a melted wax receiving bowl and the shoulder portion 4' and skirt 7' extending radially outwardly in diverging downwardly in their entirety, being continuously conical, terminating in the lower edge portion 8' which extends horizontally, flange fashion, on which the annulus 13' sits. The operation is similar to that of the first embodiment.

As the guide rods remain stationary, the second embodiment may be of lower height, enabling mounting on a plinth or conventional candle supporting structure, if greater visibility is desired.

The radially outward weight distribution of the outwardly flared bowl and the conical skirt assist in maintaining the stability of the candle and cap.

Figure 5:
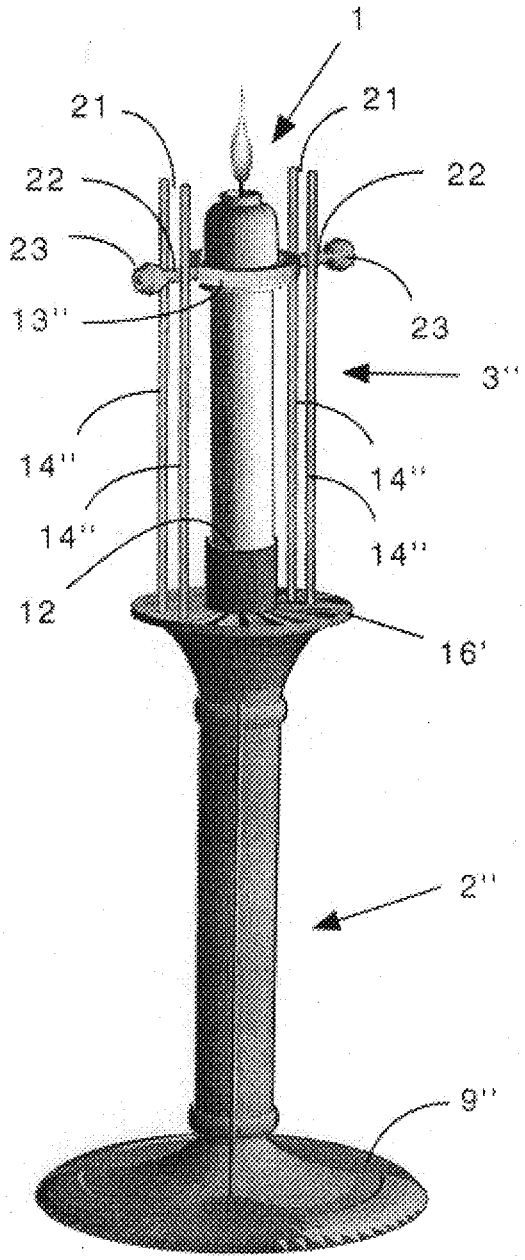
FIG. 5 is a perspective view of a third embodiment of socketless drip preventing candle holder with the candle partly consumed; and, FIG. 6 is an elevational view, partly in cross-section of a fourth embodiment of socketless drip preventing candle holder with the candle partly consumed.

In the third embodiment shown in FIG. 5, the cap member 1 is of identical construction to that of the first embodiment but the guide rods 14" of the guide means 3" are anchored in pairs on opposite sides of a circular bearing member 16' adjacent the top of the stand 2" with the rods 14" of each pair being closely spaced apart so that the socket means are defined between them as vertical slots 21, and the metal annulus 13" is integrally formed with mounting rods 22 extending radially outwardly from diametrically opposite sides thereof which carry weighty knobs 23 at free ends whereby the rods will remain captive in respective slots 21 with the cap 1 seated on the candle throughout descent of the cap.

In operation, substantially total, drip free consumption of the candle is obtained with the cap member being stabilized throughout descent by the sliding receipt of the rods 22 in the slots 21.

Figure 6:
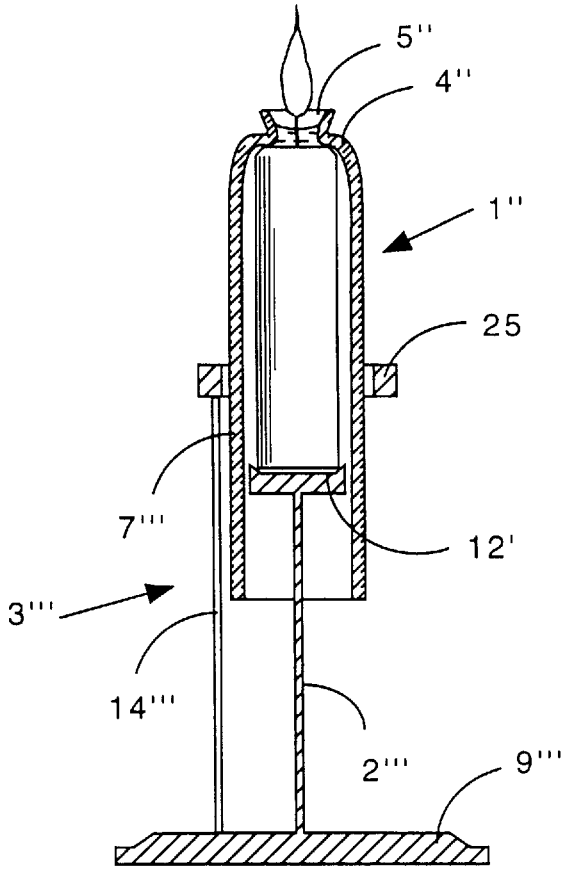

According to the fourth embodiment of the invention, shown schematically in FIG. 6, the transparent glass cap member 1" is generally similar to that of the first embodiment but the entire skirt is cylindrical and of extended axial length, longer than the candle. The stem of the candlestick 2'" is much thinner than the candle supporting surface 12' and the guide means 3'" comprises a rod 14'" upstanding from the base 9'" and carrying a guide ring 25 extending, flag fashion, in coaxial relation with the candle supporting surface and stem so as to trap the skirt between the candle supporting surface and the guide ring both prior and throughout descent of the cap member, ensuring stability of the cap member and candle.

This provides a simple and inexpensive construction which ensures reliable mounting with total, drip-free consumption of a generic type of candle, while the candle remains seen through the glass cap member throughout burning.

I claim:

1. A drip preventing candle holder of the type comprising:

a drip preventing and candle stabilizing cap having an annular shoulder portion for sitting on a shoulder of the candle to descend under gravity during consumption thereof and a central, wick receiving aperture with a lip to contain melted wax and a skirt depending from the annular shoulder portion, spaced from the candle body;

a stand having a base and an upstanding socket-less candlestick with a shallow, concave candle supporting surface at least as wide as the candle for containing melted wax and receivable in sealing engagement within the cap member during a final stage of consumption to prevent leakage of melted wax;

complementary cap guiding means on the cap member and stand including metal guide rods extending vertically between the cap member and the stand on opposite sides of the candle and socket means slidingly receiving the guide rods;

whereby the complementary guiding means maintains the drip preventing cap member on a fixed vertical axis throughout gravitation down the candle body during total consumption thereof so that the cap member retains the candle upright on the candle supporting surface;

the improvement residing in that at least a lower edge portion of the skirt extends radially outwardly, the cap guiding means includes a metal annulus which sits on the lower edge portion of the skirt to extend around the candle spaced radially outwardly therefrom and carries the metal guide rods in depending relation, the guide rod receiving socket means being located in a lateral bearing member provided on the stand at a sufficient height above the foot to permit full descent of the cap and, at a final stage of burning, the candle supporting surface engages the cap adjacent the aperture to permit total consumption of the candle.

2. A candle holder according to claim 1, wherein the cap member is made of transparent material.

3. A drip preventing candle holder of the type comprising:

a drip preventing and candle stabilizing cap member having an annular shoulder portion for sifting on a shoulder of the candle to descend under gravity during consumption thereof and a central, wick receiving aperture with a lip to contain melted wax and a skirt depending from the annular shoulder portion, spaced from the candle body;

a stand having a base and an upstanding socket-less candlestick with a shallow, concave candle supporting surface at least as wide as the candle for containing melted wax and receivable in sealing engagement within the cap member during a final stage of consumption to prevent leakage of melted wax;

complementary cap guiding means on the cap member and stand including metal guide rods extending vertically between the cap member and the stand on opposite sides of the candle and socket means slidingly receiving the guide rods;

whereby the complementary guide means maintains the cap member on a fixed vertical axis throughout gravitation down the candle body during total consumption thereof so that the cap member retains the candle upright on the candle supporting surface;

the improvement residing in that at least a lower edge portion of the skirt extends radially outwardly, the guide rods being anchored in the foot of the stand and the cap guiding means including a metal annulus which sits on the lower edge portion of the skirt extending around the candle spaced radially outwardly therefrom and is formed with the guide rod receiving sockets and, at a final stage of burning, the candle supporting surface engages the cap member adjacent the aperture to permit total consumption of the candle.

4. A candle holder according to claim 3, wherein the skirt diverges radially outwardly while extending downwards.

5. A drip preventing candle holder of the type comprising:

a drip preventing and candle stabilizing cap member having an annular shoulder portion for sitting on a shoulder of the candle to descend under gravity during consumption thereof and a central, wick receiving aperture with a lip to contain melted wax and a skirt depending from the annular shoulder portion, spaced from the candle body;

a stand having a base and an upstanding socket-less candlestick with a shallow, concave candle supporting surface at least as wide as the candle for containing melted wax and receivable in sealing engagement within the cap member during a final stage of consumption to prevent leakage of melted wax;

complementary cap guiding means on the cap member and stand including metal guide rods extending vertically between the cap member and the stand on opposite sides of the candle and socket means slidingly receiving the guide rods;

whereby the complementary guide means maintains the cap member on a fixed vertical axis throughout gravitation down the candle body during total consumption thereof so that the cap member retains the candle upright on the candle supporting surface;

the improvement residing in that at least a lower edge portion of the skirt extends radially outwardly, the cap guiding means including a metal annulus which sits on the lower edge portion of the cap extending around the candle spaced radially outwardly therefrom, the guide rods being anchored in pairs on opposite sides of the foot of the stand with the rods of each pair being closely spaced apart so that the socket means are defined between them as vertical slots, and mounting rods extend radially outwardly from opposite sides of the annulus and carrying weighty knobs at free ends, whereby the rods remain captive in respective slots with the cap member seated on the candle throughout descent and the candle supporting surface engaging the cap adjacent the aperture at a final stage of burning to permit total consumption of the candle.

6. A candle holder according to claim 5, wherein the cap member is made of transparent material.

7. A drip preventing candle holder of the type comprising:

a drip preventing and candle stabilizing cap member having an annular shoulder portion for sifting on a shoulder of the candle to descend under gravity during consumption thereof and a central, wick receiving aperture with a lip to contain melted wax and an elongate cylindrical skirt depending from the annular portion for containing an entire candle body;

a stand having a base and an upstanding, socket-less candlestick with a candle supporting surface and receivable in sliding engagement within the skirt for guiding the descent of the cap member througout the entire burning of the candle and for sealing engagement within cap member during a final stage of consumption to prevent leakage of melted wax;

the improvement residing in that, the cap member is made of transparent material with the skirt spaced from the candle body and the guide means includes a guide ring mounted, flag fashion, by a rod upstanding from the base to extend in coaxial relation with the candle supporting surface and stem whereby the skirt will be trapped between the candle supporting surface and the guide ring thereby guiding the for vertical descent.

8. A candle holder according to claim 7 wherein and the candlestick has a thin stem of less width than the candle supporting surface.

9. A candle holder according to claim 8 wherein the guide ring is positioned above the candle supporting surface.

10. A candle holder according to claim 7 wherein the cap member is formed in one piece.

* * * * *